US005201266A

United States Patent [19]

Schmalz et al.

[11] Patent Number: 5,201,266

[45] Date of Patent: Apr. 13, 1993

[54] BALER MACHINE AND METHOD OF BALING

[75] Inventors: Roman Schmalz, Milwaukee; Robert J. Wolf, Waukesha; Erich E. Salzmann, Milwaukee, all of Wis.

[73] Assignee: Logemann Bros. Co., Milwaukee, Wis.

[21] Appl. No.: 774,438

[22] Filed: Oct. 10, 1991

[51] Int. Cl.[5] ..... B30B 13/00; B30B 15/32

[52] U.S. Cl. ..... 100/35; 100/42; 100/218; 100/232; 100/246

[58] Field of Search ..... 100/35, 42, 218, 232, 100/244, 246, 247, 249, 251

[56] References Cited

U.S. PATENT DOCUMENTS

| | | | |
|---|---|---|---|
| 2,955,529 | 10/1960 | Marble | 100/244 X |
| 3,438,319 | 4/1969 | Raab | 100/244 X |
| 3,576,161 | 4/1971 | Wright | 100/218 X |
| 4,086,850 | 5/1978 | Becker et al. | 100/42 |
| 4,127,062 | 11/1978 | Egosi | 100/244 X |
| 4,658,719 | 4/1987 | Jackson et al. | 100/242 X |
| 5,007,337 | 4/1991 | Newsom | 100/218 X |
| 5,081,922 | 1/1992 | Rudd, Jr. et al. | 100/218 X |

FOREIGN PATENT DOCUMENTS

| | | | |
|---|---|---|---|
| 494195 | 3/1930 | Fed. Rep. of Germany | 100/244 |
| 617285 | 7/1978 | U.S.S.R. | 100/244 |
| 1143652 | 3/1985 | U.S.S.R. | 100/218 |

*Primary Examiner*—Stephen F. Gerrity
*Attorney, Agent, or Firm*—Paul R. Puerner

[57] ABSTRACT

A baler machine including a charging chamber for receiving material to be baled. The charging chamber has a charging passage through which material is forced into a baling compression chamber by a compression ram to thereby form a bale in the compression chamber. An ejection ram is provided for forcing the compressed material out of the baling compression chamber through an exit passageway. A movable decompression wall functions as one wall of the baling compression chamber. Such wall is located opposite and spaced from the charging passage through which material is forced from the charging chamber. A power cylinder is provided to move the decompression wall in a horizontal direction to effectively increase the volume of the baling compression chamber which, at the same time, increases the size of the exit passageway to thereby permit ejection of an oversized bale from the compression chamber.

6 Claims, 4 Drawing Sheets 10
12
14
16
18
20
22
24
26
28
30
32
34
36
38
40
42

14
24
26
36

BALER MACHINE AND METHOD OF BALING

BACKGROUND OF THE INVENTION

In a conventional baler machine which is not equipped with the improvement of this invention, the compression ram head will on occasion move too much material into the compression chamber where the bale is formed so that the material protrudes back from the compression chamber into the charging passage which leads from the charging chamber to the compression chamber. Such a situation may occur, for example, if an excessive amount of material is originally charged into the bale charging chamber. Under such a condition, the compression ram head cannot be advanced to its normal baling eject position, i.e., with the base of the compression ram head in alignment with the side wall of the discharge passage from the compression chamber through which the bale is ejected. Under such circumstances, the width of the bale will be greater than that of the discharge passage and thus the oversized bale cannot be ejected through the discharge passage by the ejector ram head. In a conventional baler, such an oversized bale condition wherein the bale cannot be ejected can be remedied only by a manual removal of the excess material in the baling chamber to thereby reduce the size of the oversized bale. Such a manual removal operation is time-consuming.

One attempt to deal with this problem is a baler mechanism described in U.S. Pat. No. 4,658,719. In such machine, one wall section of the exit passageway from the bale compression chambers is made to be movable in a vertical direction which, when necessary, can be moved to its fully vertical position to thereby increase the effective size of the exit passageway from the compression chamber. Such a movable wall section is only effective if it is moved to its fully retracted position and the amount of the enlargement of the exit passageway size is fixed.

As will be explained more fully in the description which follows, the baler of the present invention contemplates a design wherein the increase in the exit passageway size can be varied within a range to thus accommodate oversized bales of various size. Other advantages will be apparent from the description which follows.

SUMMARY OF THE INVENTION

A baler machine comprising a charging chamber for receiving material to be baled, said charging chamber having charging passageway through which material is forced into a baling compression chamber by a compression ram. An ejector ram is provided for forcing compressed material in bale form out of the baling compression chamber through an exit passageway. A movable decompression wall is provided which functions as one wall of the baling compression chamber. Such decompression wall is located opposite and spaced from the charging passage from said charging chamber. A power means is provided to move the decompression wall from a normal operating position to a second position wherein the effective volume of the baling compression chamber is increased, which movement will also effectively increase the size of the exit passageway to thus permit the ejection of an oversized bale in the compression chamber should such a condition be encountered. In a preferred embodiment, the horizontal movement of the decompression wall and alternatively the size of the exit passageway is made to be variable.

DETAILED DESCRIPTION OF THE INVENTION

Figure 1:
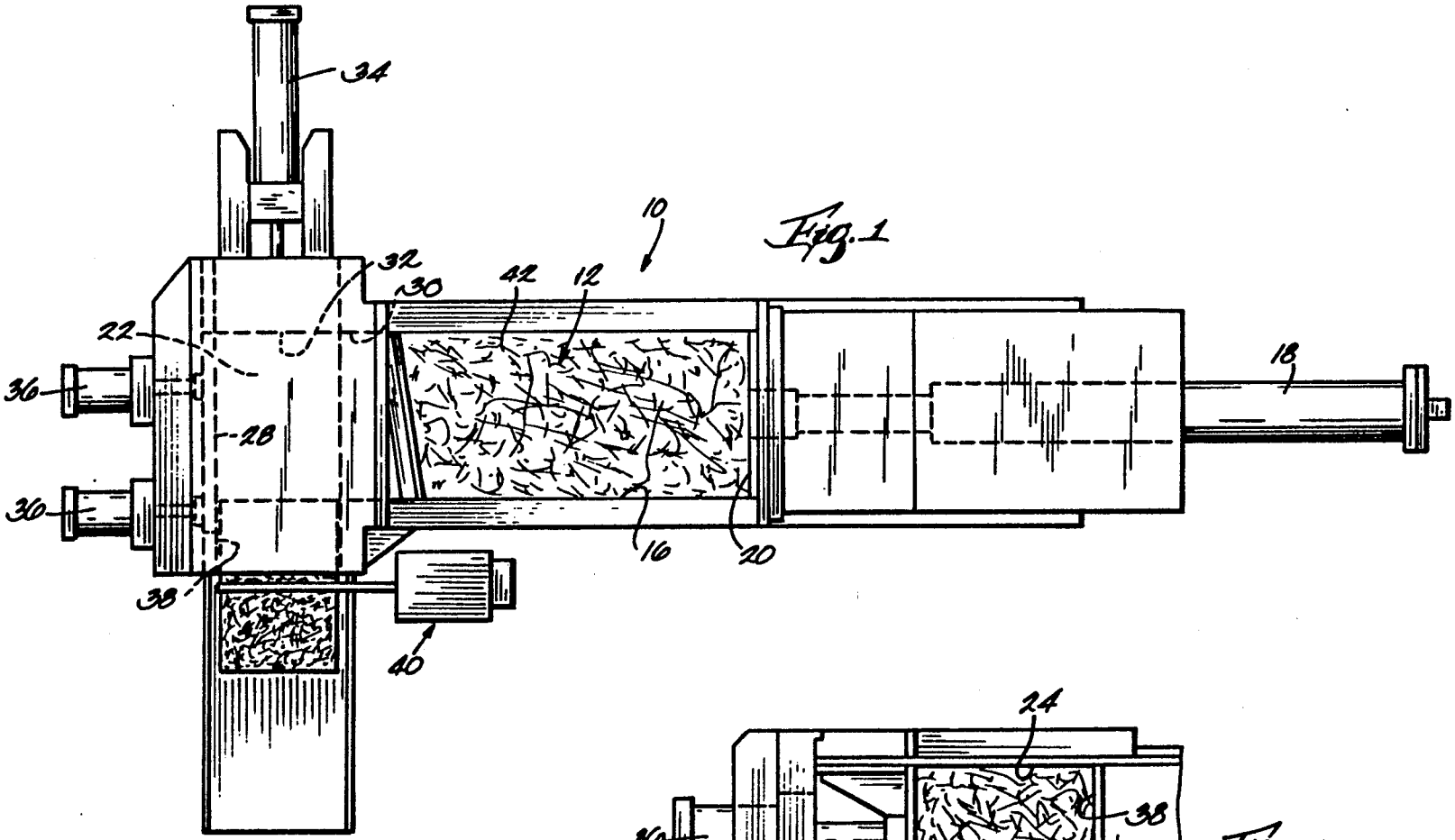
FIG. 1 is a partially schematic plan view of the baling machine of this invention.
Figure 2:
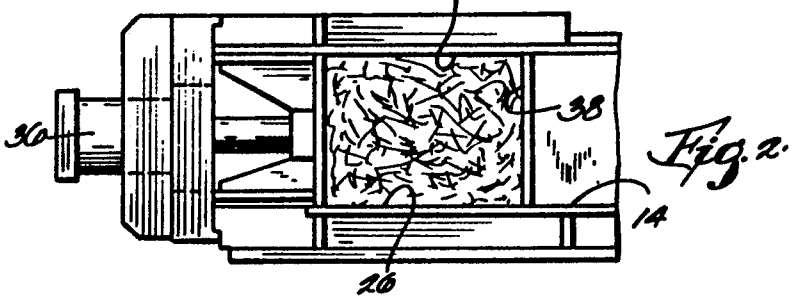
FIG. 2 is a view taken along line 2—2 of FIG. 1.

Referring to the drawings, baler machine 10 is designed for baling waste material such as paper, cardboard, corrugated containers, used beverage cases, municipal solid waste, etc. Machine 10 has a charging chamber 12 into which waste material is loaded. The charging chamber 12 is generally rectangular in horizontal section having a flat floor 14 and opposed side walls 16. The baler machine 10 includes a hydraulic compression cylinder 18 having a compression ram head 20 which is movable horizontally in the charging chamber 12.

The charging chamber 12 communicates with a compression chamber 22 through a charging passage 30. Compression chamber 22 has a fixed upper wall 24, a fixed floor 26 and a movable bale decompression wall 28 located opposite and spaced from charging passage 30 through which waste material is compressed from the charging chamber 12 into the compression chamber 22 by the forward movement of compression ram head 20. Bale decompression wall 28 forms one wall of compression chamber 22.

The compression chamber 22 further includes a bale ejection cylinder 34 having an ejection ram head 32. Wall 28 is movable horizontally relative to the compression chamber by a bale decompression cylinder or pair of bale decompression cylinders 36. The compression chamber 22 is further provided with a exit passageway 38. Shown schematically at the exit passageway 38 is a bale strapping apparatus of suitable design indicated by reference numeral 40.

OPERATION

To describe the operation, reference is made to FIGS. 3, 4, 5, and 6. After the charging chamber 12 has been filled with waste material 42, the charging ram head 20 is advanced to push waste material through the charging passage 30 and into the compression chamber 22.

After the chamber 22 has been filled with waste material and compressed to a suitable density, the charging ram head 20 stops in advanced position substantially flush with the corresponding side or edge of the ejection ram head 32. The ejection ram head 32 is then advanced step-by-step to push the material out of the baling chamber 22 through the exit passage 38, which retains the compressed material in its bale shape while it is tied by strapping apparatus 40. At each pause between incremental advances of the ram 32 the ejected material is tied with an encircling strap or wire by strapping mechanism 40 located just outside the exit passage 38 to prevent expansion of the compressed material to retain its bale configuration.

The strapped bale in the exit passageway serves as a cork so that a second bale can be formed in the compression chamber as described above. The rear face of the bale serves as a wall of chamber 22 as the next bale is formed. The above describes a normal bale forming operation.

Figure 3:
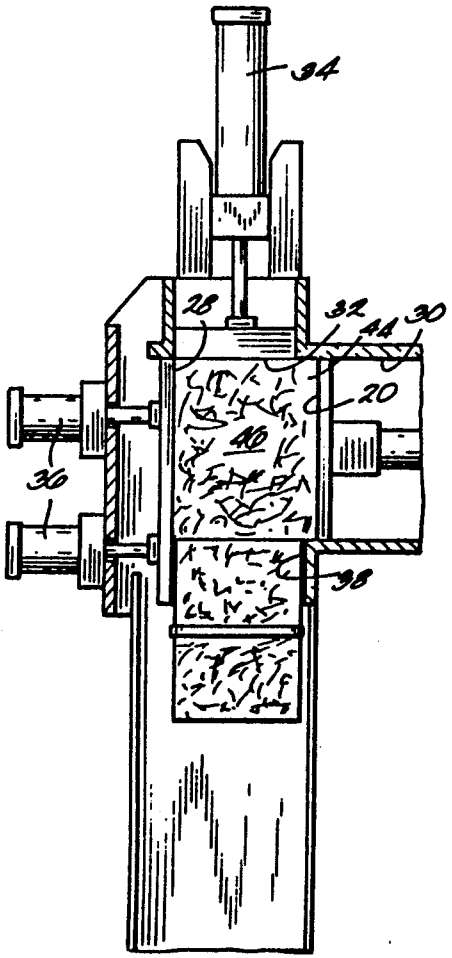

The problem to which this invention is directed is a situation where too much waste material is charged into the baling chamber 22 for the compression ram head 20 to push the last charge of material completely out of the charging passage 30 into the baling compression chamber 22. The condition is shown in FIG. 3, wherein a portion 44 of the charge in the chamber 22 protrudes back into the charging passage 30, making it difficult, if not impossible, to eject the compressed material in the chamber 22 through the exit passage 38 by the operation of the ejection ram head 32. A time-consuming manual clearing of the jam would then be necessary absent the presence of the improvement described herein.

Figure 6:
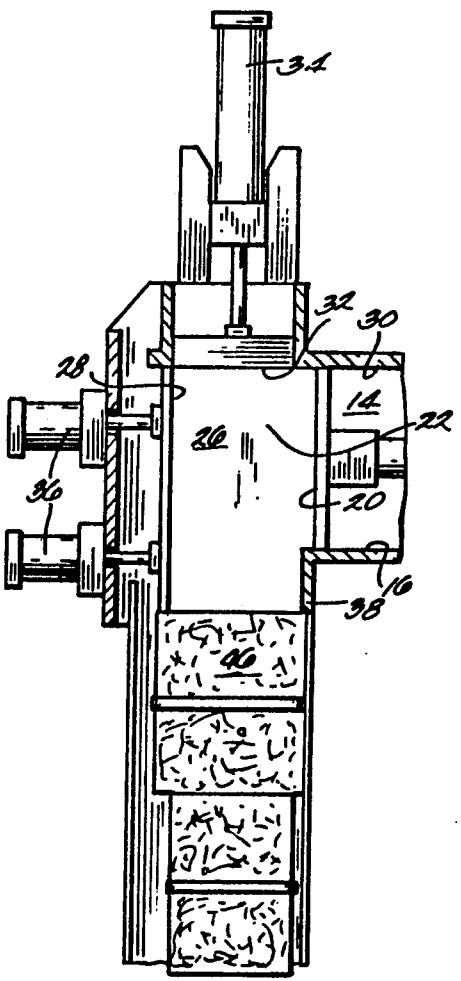
FIGS. 3, 4, 5, and 6 are partially schematic plan views showing the baler machine in its various operational positions.
Figure 5:
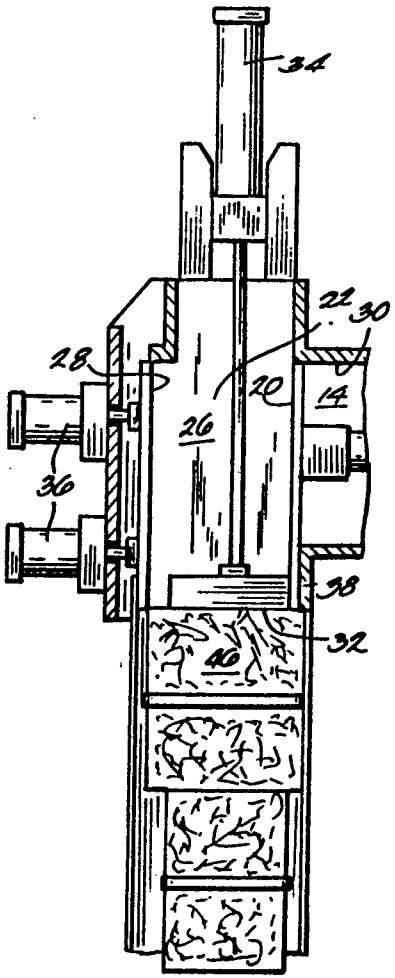
Figure 4:
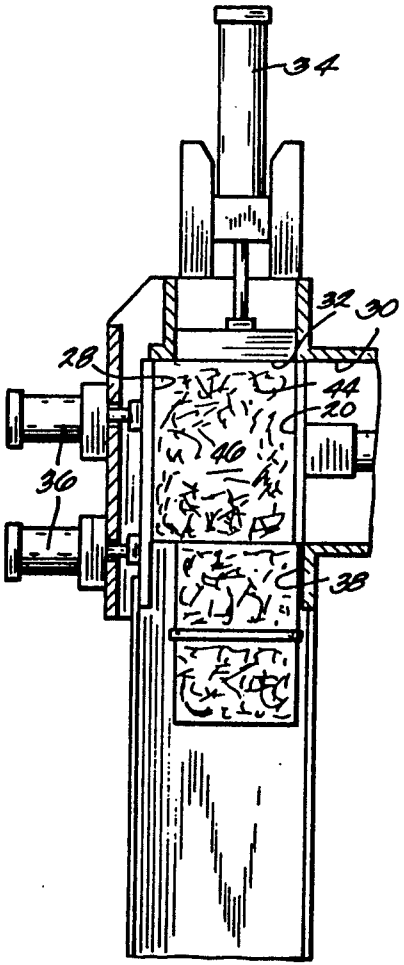

This problem is very effectively solved as shown in FIGS. 4, 5 and 6. Referring first to FIG. 4, wall 28 is retracted by decompression cylinder(s) 36 a sufficient distance to allow the compression ram head 20 to force the enlarged bale 46 to the position shown in FIG. 4.

In the preferred embodiment, the wall 28 is designed to retract a variable distance and thus the effective size of the exit passageway can be adjusted (varied) as necessary to accommodate bales of various degrees of oversize. With the machine in the FIG. 4 position, the enlarged bale 46 can now be ejected from the compression chamber 22 by ejector ram head 32 as shown in FIG. 5. In this position, the discharge passageway from the compression chamber 22 is in effect enlarged by the retracted movement of wall 28. It will be appreciated from the above description that decompression wall 28 functions as one wall of the baling compression chamber 22 and that as it is retracted, the volume of the compression chamber 22 will be increased. Thus, as indicated, such retracted movement of wall 28 very effectively facilitates ejection of the enlarged bale 46 from the baling chamber 22.

Wall 28 is then returned to its original position as shown in FIGS. 3 and 6 and the bale forming operation can continue.

FIGS. 7–10 show schematic views of a second embodiment of the present invention. Generally speaking, the baler machine 48 of this embodiment is basically the same as the baler machine 10 described above.

Baler machine 48 is comprised of a charging chamber 50, a compression cylinder 52, a compression ram head 54, an ejection cylinder 56, an ejection ram head 58, a movable bale decompression wall 60 defining a compression chamber 62. The decompression wall 60 is actuated horizontally by a decompression cylinder 66. A bale gate 68 is mounted at the exit passageway 69 from the compression chamber 62. The bale gate 68 is comprised of a gate section 70 mounted for horizontal movement by a power cylinder 72 connected to the gate section 70 by a connector bracket 74 fastened to one end of the gate.

OPERATION (FIGS. 7–10 EMBODIMENT)

Figure 7:
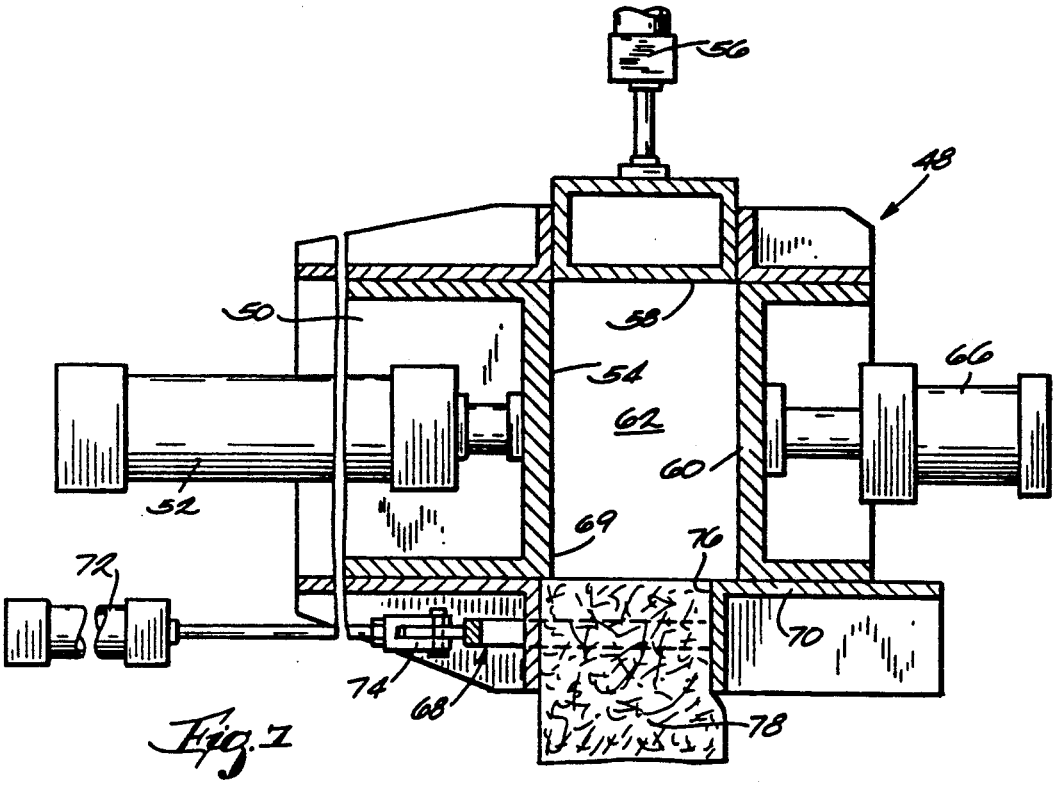
FIGS. 7-9 show schematic views of a modified embodiment of the present invention.

FIG. 7 shows a first position of the baler machine with the gate section 70 of bale gate 68 in its partially closed position wherein the end portion 76 of the gate section 70 clamps the cork bale 78 at the exit passageway 69, thereby preventing the bale from extruding during formation of a new bale by the compression ram head 54.

Figure 8:
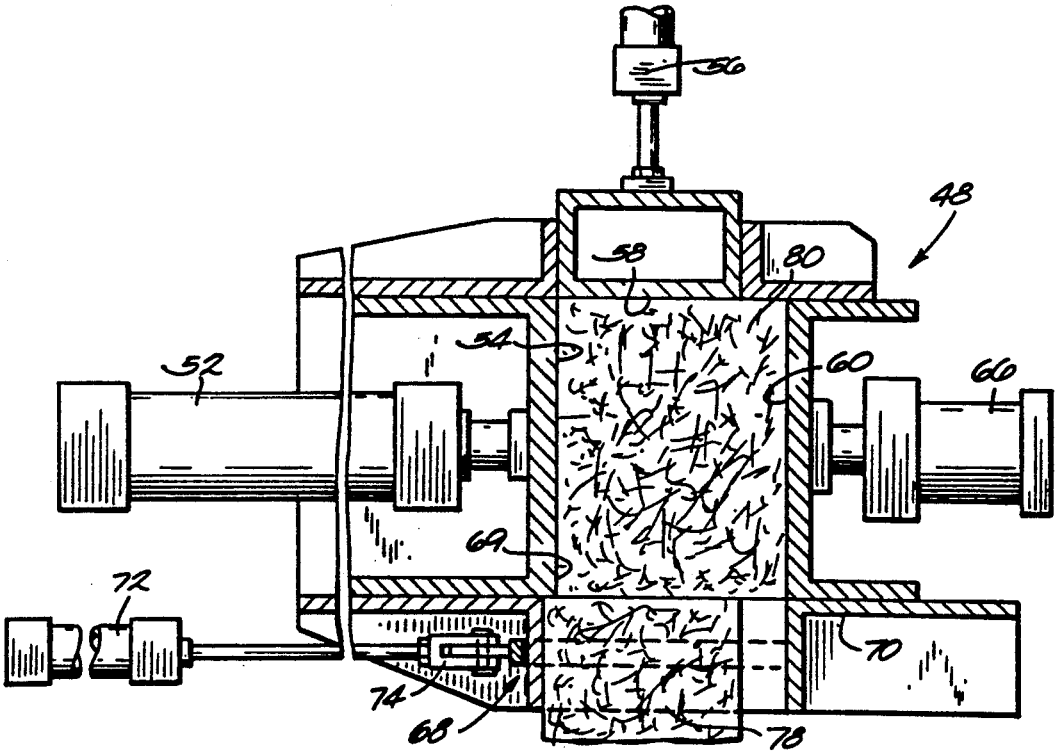

FIG. 8 shows a second position of the baler machine wherein the bale gate 68 is moved to its fully open position and the decompression wall 60 is retracted to permit the ejection ram head 56 to force an oversized bale 80 through the exit passageway 69.

Figure 9:
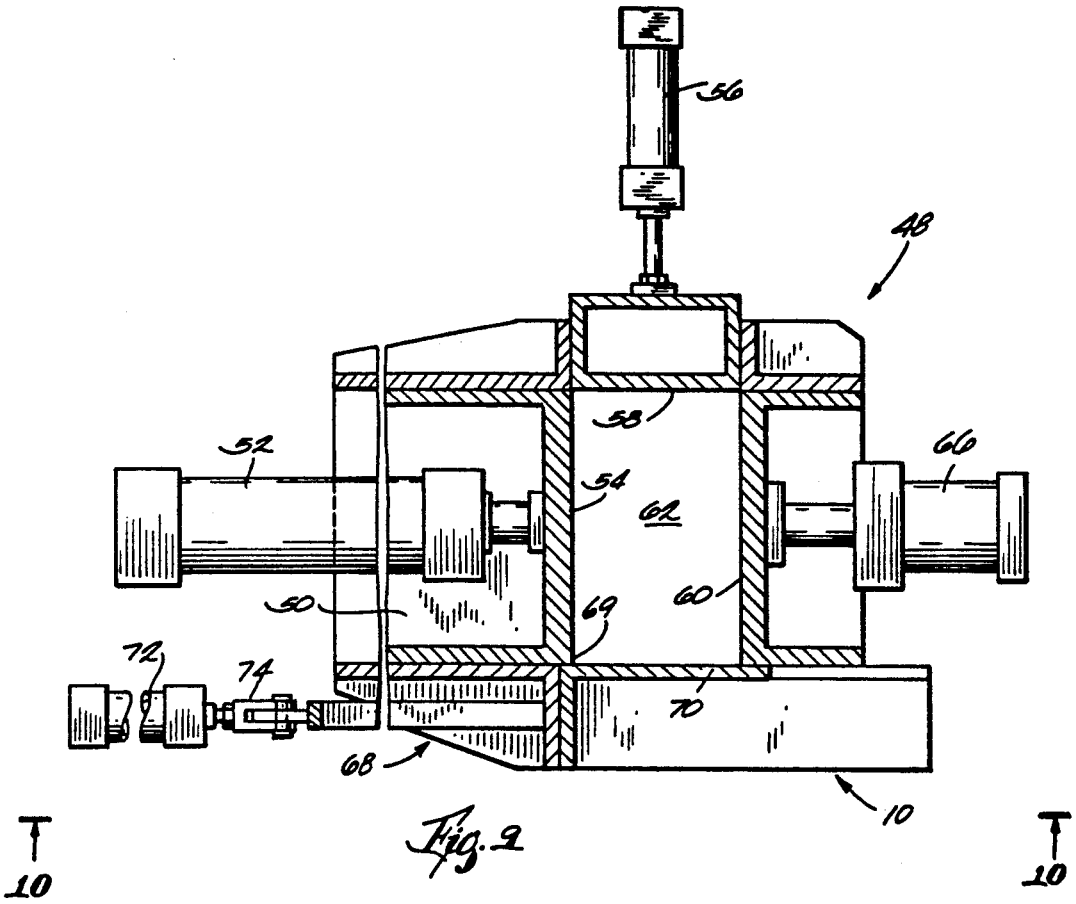
Figure 10:
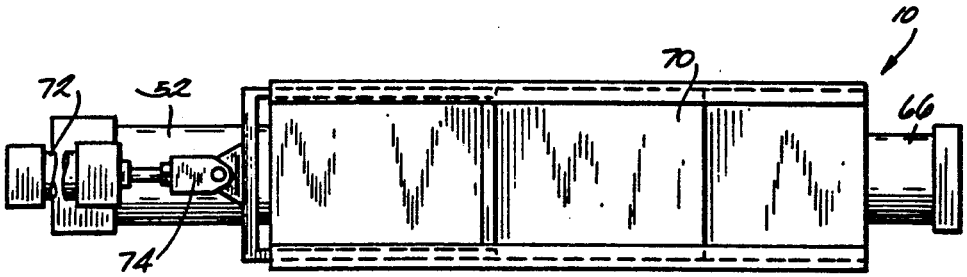
FIG. 10 is a view taken along line 10—10 of FIG. 9.

FIG. 9 shows a third operating position of the baler mechanism with the bale gate 68 in its fully closed position. This position is useful when the consistency of the material to be baled is such that the material in the baling chamber 62 would tend to become extruded through the exit passageway 69 during the formation of a bale in chamber 62. With the bale gate closed as shown in FIG. 9, such extrusion is prevented. The closed position of the bale gate 68 may also be useful when switching from one type of material to another type of material to be processed by the baler machine.

We claim:

1. A baler machine comprising:

(a) a charging chamber means for receiving material to be baled, said charging chamber means having a charging passage means;

(b) a baling compression chamber means communicating with said charging chamber means through said charging passage means, said baling compression chamber means having an exit passageway means;

(c) a compression ram means operable to force material from said charging chamber means into said baling compression chamber means through said charging passage means to thereby compress material in said baling compression chamber means;

(d) ejector ram means for forcing compressed material out of said baling compression chamber through said exit passageway means, said exit passageway means positioned at one end of said compression chamber opposite said bale ejection means;

(e) a movable decompression wall means which functions as a wall of said baling compression chamber means, said movable decompression wall means located adjacent said exit passageway means and located opposite and spaced from said charging passage means of said charging chamber means, said movable decompression wall means movable relative to said exit passageway means to vary the size of said exit passageway means; and (f) power means operatively connected to said movable decompression wall means to move said movable decompression wall means from its normal operating position in a first direction to effectively increase the size of said exit passageway means and further operable when moved in the opposite direction to effectively decrease the size of said exit passageway means as said movable decompression wall means is moved back to its normal operating position by said power means.

2. A baler machine according to claim 1 wherein said power means is operable to move said movable decompression wall means a variable distance.

3. A baler machine comprising:

(a) a charging chamber means for receiving material to be baled, said charging chamber means having a charging passage means;

(b) a baling compression chamber means communicating with said charging chamber means through said charging passage means, said baling compression chamber means having an exit passageway means;

(c) a compression ram means operable to force material from said charging chamber means into said baling compression chamber means through said charging passage means to thereby compress material in said baling compression chamber means;

(d) ejector ram means for forcing compressed material out of said baling compression chamber through said exit passageway means, said exit passageway means positioned at one end of said compression chamber opposite said bale ejection means;

(e) a movable decompression wall means which functions as a wall of said baling compression chamber means, said movable decompression wall means located adjacent said exit passageway means and located opposite and spaced from said charging passage means of said charging chamber means, said movable decompression wall means movable relative to said exit passageway means, to vary the size of said exit passageway means; and (f) power means operatively connected to said movable decompression wall means to move said movable decompression wall means from its normal operating position in a first direction to effectively increase the size of said exit passageway means and further operable when moved in the opposite direction to effectively decrease the size of said exit passageway means as said movable decompression wall means is moved back to its normal operating position by said power means; and (g) a bale gate means mounted at said exit passageway means of said baling compression chamber means, said bale gate means operable to a partially closed position to clamp a formed bale at the exit passageway means, said bale gate means further operable to be moved to a fully open position to allow free movement of a bale from the baling chamber means through said exit passageway means, and said bale gate means further operable to be moved to a fully closed position to prevent any material in said baling compression chamber means to be extruded out through said exit passageway means.

4. A baler machine according to claim 3 wherein said power means is operable to move said movable decompression wall a variable distance.

5. A method of forming bales comprising the steps of:

(a) loading material into a charging chamber having a charging passage;

(b) forcing the material in the charging chamber through the charging passage into a bale compression chamber to form a bale therein, said bale compression chamber having a side wall facing the charging passage which is movable horizontally, said bale compression chamber having an exit passageway through which bales are ejected, said side wall located adjacent said exit passageway and movable horizontally to vary the size of said exit passageway;

(c) moving said side wall of said baling chamber horizontally to increase the size of said exit passageway to thereby facilitate ejection of an oversized bale from said baling compression chamber; and (d) ejecting the oversized bale through the enlarged exit passageway of said baling compression chamber.

6. A method of forming bales comprising the steps of:

(a) loading material into a charging chamber having a charging passage;

(b) forcing the material in the charging chamber through the charging passage into a bale compression chamber to form a bale therein, said bale compression chamber having a side wall which is movable horizontally and is spaced from and positioned opposite the charging passage, said bale compression chamber having an exit passageway through which bales are ejected, said side wall located adjacent said exit passageway and movable horizontally to vary the size of said exit passageway;

(c) moving said side wall of said bale compression chamber horizontally to increase the size of the exit passageway to thereby facilitate ejection of an oversized bale from said bale compression chamber; and (d) ejecting the oversized bale through the enlarged exit passageway of said baling compression chamber.

* * * * *